US009611800B2

(12) United States Patent
Veit et al.

(10) Patent No.: US 9,611,800 B2
(45) Date of Patent: Apr. 4, 2017

(54) METHOD FOR OPERATING A FUEL SYSTEM OF AN INTERNAL COMBUSTION ENGINE

(75) Inventors: Guenter Veit, Plochingen (DE); Stefan Keller, Stuttgart (DE)

(73) Assignee: ROBERT BOSCH GMBH, Stuttgart (DE)

( * ) Notice: Subject to any disclaimer, the term of this patent is extended or adjusted under 35 U.S.C. 154(b) by 1552 days.

(21) Appl. No.: 11/792,898

(22) PCT Filed: Oct. 20, 2005

(86) PCT No.: PCT/EP2005/055417
§ 371 (c)(1),
(2), (4) Date: Feb. 28, 2008

(87) PCT Pub. No.: WO2006/061288
PCT Pub. Date: Jun. 15, 2006

(65) Prior Publication Data

US 2008/0257314 A1 Oct. 23, 2008

(30) Foreign Application Priority Data

Dec. 9, 2004 (DE) ..... 10 2004 059 330

(51) Int. Cl.
*F02D 41/38* (2006.01)
*F02D 41/14* (2006.01)

(52) U.S. Cl.
CPC ..... *F02D 41/3863* (2013.01); *F02D 41/1401* (2013.01); *F02D 2041/141* (2013.01); *F02D 2200/0602* (2013.01); *F02D 2250/31* (2013.01)

(58) Field of Classification Search
CPC ..... F02D 2200/0602; F02D 41/3845; F02D 41/3863; F02D 41/1401; F02D 41/0025; F02D 41/3082; F02D 41/0027; F02D 2250/31; F02M 55/025; F02M 63/0275; F02M 59/366; F02M 63/0225; F02M 69/465; F02M 63/0265; F02M 59/20
(Continued)

(56) References Cited

U.S. PATENT DOCUMENTS 5,345,916 A * 9/1994 Amann et al. ..... 123/506
6,311,674 B1 * 11/2001 Igashira et al. ..... 123/458
(Continued)

FOREIGN PATENT DOCUMENTS

DE 101 12 702 10/2002
DE 101 58 950 6/2003
(Continued)

*Primary Examiner* — Sizo Vilakazi
(74) *Attorney, Agent, or Firm* — Gerard Messina

(57) ABSTRACT

In a fuel system for an internal combustion engine, the fuel is pumped by a high-pressure fuel pump into a fuel pressure accumulator, from which it is supplied into at least one combustion chamber via at least one injector. A value is provided for the actual pressure in the fuel pressure accumulator. A pressure regulating device using which the fuel may be extracted from the fuel pressure accumulator is precontrolled using a precontrol signal, which is ascertained taking into account a setpoint pressure in the fuel pressure accumulator. A value for a fuel quantity flowing through the pressure regulating device is taken into account when ascertaining the precontrol signal.

8 Claims, 2 Drawing Sheets

(58) Field of Classification Search
USPC ..... 123/510, 511, 446, 447, 458, 496, 456
See application file for complete search history.

(56) References Cited

U.S. PATENT DOCUMENTS

| | | | | |
|---|---|---|---|---|
| 6,450,147 | B2 * | 9/2002 | Demura et al. | 123/458 |
| 6,840,220 | B2 * | 1/2005 | Yomogida et al. | 123/456 |
| 7,422,002 | B2 * | 9/2008 | Mueller | 123/458 |
| 2003/0192508 | A1 * | 10/2003 | Kishimoto | 123/447 |
| 2004/0016830 | A1 * | 1/2004 | Boos et al. | 239/533.2 |
| 2004/0168673 | A1 * | 9/2004 | Shinogle | 123/456 |
| 2005/0199219 | A1 * | 9/2005 | Utsumi | 123/458 |
| 2006/0225707 | A1 * | 10/2006 | Eser et al. | 123/458 |

FOREIGN PATENT DOCUMENTS

| | | | | |
|---|---|---|---|---|
| DE | 101 62 989 | | 10/2003 | |
| DE | 10162989 | C1 * | 10/2003 | F02D 41/38 |
| EP | 1 086 307 | | 10/2000 | |
| JP | 11-101148 | | 4/1999 | |
| JP | 2001-349244 | | 12/2001 | |
| WO | WO 2004094806 | A1 * | 11/2004 | F02D 41/38 |

* cited by examiner

METHOD FOR OPERATING A FUEL SYSTEM OF AN INTERNAL COMBUSTION ENGINE

FIELD OF THE INVENTION

The present invention first relates to a method for operating a fuel system of an internal combustion engine in which a pressure regulating device is precontrolled using a precontrol signal, which is ascertained taking into account a setpoint pressure in an area of the fuel system, in particular in a fuel pressure accumulator.

The present invention further relates to a computer program, an electric memory medium for an open- and/or closed-loop control unit of an internal combustion engine, an open- and/or closed-loop control unit for an internal combustion engine, and an internal combustion engine, in particular for a motor vehicle.

BACKGROUND INFORMATION

A method is described in European Patent No. EP 1 086 307. This document describes a fuel system in which the quantity pumped by a high-pressure fuel pump and the opening pressure of a pressure regulating valve connected to a fuel pressure accumulator may be influenced. Both the high-pressure fuel pump and the pressure regulating valve are triggered by a controller, with the help of which a certain pressure may be set or adjusted in the fuel pressure accumulator. Precontrol is provided to increase the dynamics and precision of the pressure regulation. The pressure regulating valve is precontrolled as a function of, among other things, a setpoint pressure in the fuel pressure accumulator.

SUMMARY OF THE INVENTION

An object of the present invention is to refine a method of the type named above in such a way that the pressure in the fuel pressure accumulator may be adjusted with a higher accuracy and/or the pressure regulating device may be manufactured more economically.

This object is achieved with a method according to the present invention by taking into account a value for a fuel quantity flowing through the pressure regulating device when ascertaining the precontrol signal. The above-named object is achieved with a computer program, an electric memory medium, an open- and/or closed-loop control unit, and an internal combustion engine according to the present invention.

It has been recognized according to the present invention that the control signal which is required for holding a certain pressure in an area of the fuel system, for example, in a fuel pressure accumulator, is a function of the fuel quantity flowing from that area through the pressure regulating device. The desired pressure may be set with a much higher accuracy and better dynamics by taking into account this fuel quantity or a value at least approximately corresponding to it when determining the precontrol signal with the aid of which the pressure regulating device is triggered. The required regulating interventions are thus smaller, which also improves the dynamics in adjusting the pressure in the fuel pressure accumulator.

In addition, when using the method according to the present invention, a pressure regulating device which is manufactured with greater tolerances may be used, since the dependence of the control signal required for a certain pressure in the area on the fuel quantity flowing through the pressure regulating device is the greater the greater the tolerances with which the pressure regulating device is manufactured. However, since this dependence is taken into account according to the present invention, the tolerances of the pressure regulating device have a diminished role.

In an advantageous refinement of the method according to the present invention, a fuel quantity pumped by a high-pressure fuel pump is taken into account when ascertaining the value for the fuel quantity flowing through the pressure regulating device. It is based on the fact that, when a certain pressure level is to be held, for example, in the fuel pressure accumulator, the fuel quantity flowing through the pressure regulating device is the greater the greater the fuel quantity pumped by the high-pressure fuel pump. This simplifies the ascertainment of the precontrol signal for the pressure regulating device, while its precision is improved.

If the high-pressure fuel pump is driven mechanically by the internal combustion engine, the fuel quantity it pumps is a direct function of the internal combustion engine's speed. Taking into account this engine speed considerably simplifies the ascertainment of the fuel quantity flowing through the pressure regulating device.

In ascertaining the value for the fuel quantity flowing through the pressure regulating device, a fuel quantity reaching the combustion chamber via an injector may also be taken into account. This also increases the precision in ascertaining the fuel quantity flowing through the pressure regulating device and thus allows the precontrol signal to be more precisely ascertained.

The refinement of the method according to the present invention, in which a fuel quantity controlled by an injector is taken into account when ascertaining the value for a fuel quantity flowing through the pressure regulating device, aims in the same direction. Such a fuel quantity is needed for operating the injector.

The method according to the present invention is easily implemented from the programming point of view when a factor is ascertained from the value for a fuel quantity flowing through the pressure regulating device, and a raw precontrol signal which is ascertained by taking into account a setpoint pressure in the area of the fuel system, in particular in the fuel pressure accumulator, is multiplied by this factor.

Furthermore, in ascertaining the factor, a value for the instantaneous pressure in the area of the fuel system, in particular in the fuel pressure accumulator, may also be taken into account, in which case the latter also affects the precontrol signal using which the pressure regulating device must be triggered for setting a certain pressure in the fuel pressure accumulator.

DETAILED DESCRIPTION

Figure 1:
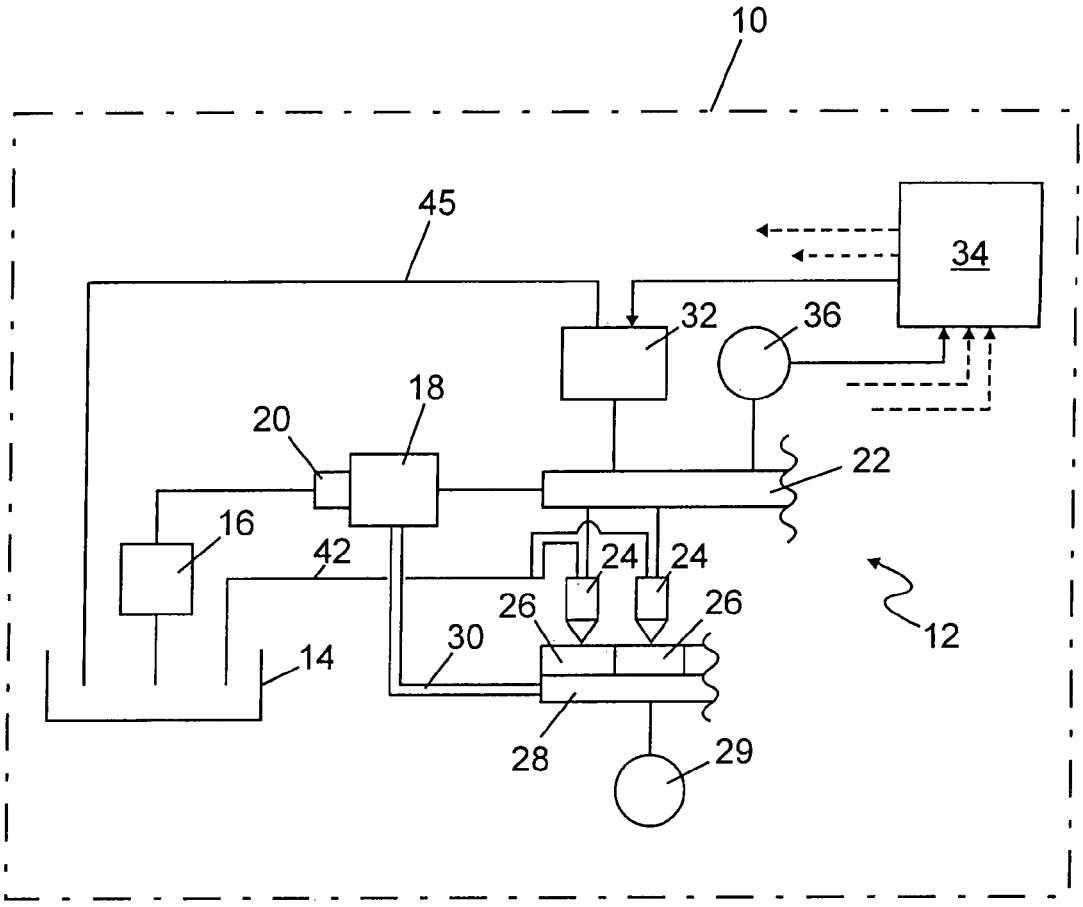
FIG. 1 shows a schematic depiction of an internal combustion engine having a fuel system including a pressure regulating device.

An internal combustion engine overall is identified with the reference numeral 10 in FIG. 1. It includes a fuel system 12.

A fuel reservoir 14, from which an electrically driven fuel presupply pump 16 pumps the fuel to a mechanically driven high-pressure fuel pump 18, is part of fuel system 12. Its pumping capacity is adjustable via a flow control valve or a metering unit 20.

High-pressure fuel pump 18 pumps the fuel into a fuel pressure accumulator 22, to which a plurality of injectors 24 is connected. Rail 22 represents a fuel pressure accumulator. Injectors 24 inject the fuel directly into combustion chambers 26, which are directly assigned to them. During the operation of internal combustion engine 10, a crankshaft 28 is set into rotation and its rotational speed is detected by a sensor 29; it drives high-pressure fuel pump 18 via a mechanical link 30.

To set a certain pressure in fuel pressure accumulator 22, the latter is connected to an adjustable and triggerable pressure regulating device 32. This may be a pressure regulating valve having a spring-loaded valve element. To be able to adjust the opening pressure of such a pressure regulating valve, the prestressing force of the spring acting on the valve element may be varied using an electromagnetic actuating device. An open- or closed-loop control unit 34, which receives signals such as input signals from a pressure sensor 36 which detects the pressure in fuel pressure accumulator 22, delivers the appropriate trigger signal. Pressure regulating device 32, fuel pressure accumulator 22, open- and closed-loop control unit 34, and pressure sensor 36 thus form a closed control loop.

A setpoint pressure in fuel pressure accumulator 22 is defined in open- and closed-loop control unit 34 as a function of state and performance quantities of internal combustion engine 10. The state and performance quantities capable of influencing the setpoint pressure in fuel pressure accumulator 22 include, for example, the operating mode of internal combustion engine 10, the load torque and engine torque to be output by internal combustion engine 10, the rotational speed of crankshaft 28 detected by sensor 29, a temperature of internal combustion engine 10, and others.

Figure 2:
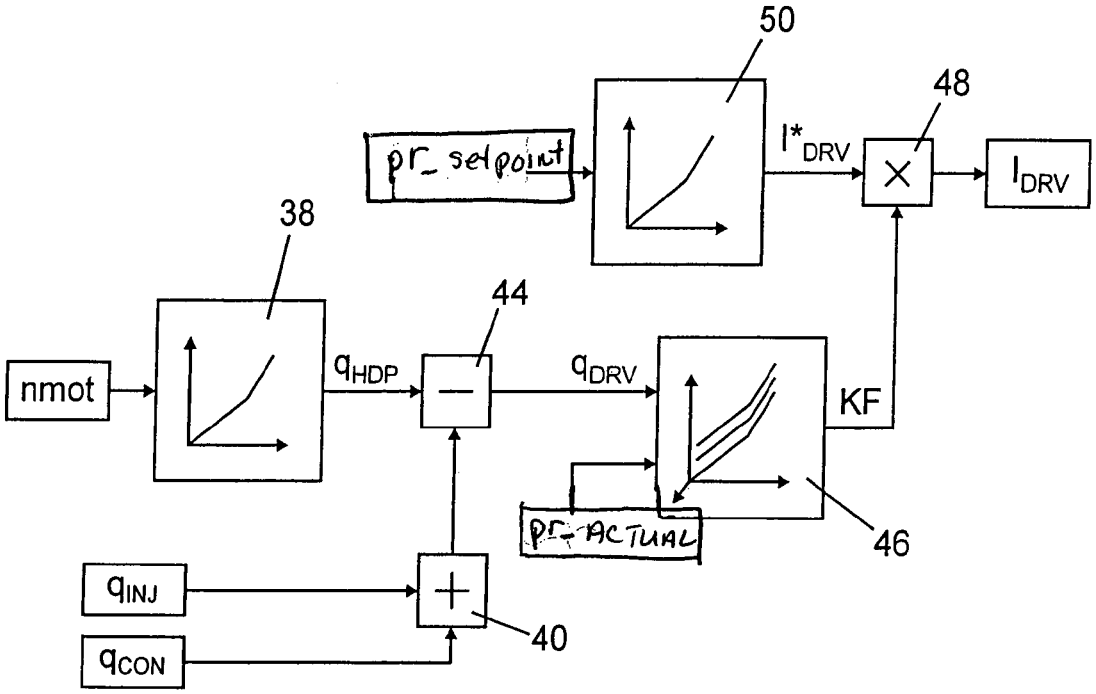
FIG. 2 shows a flow chart of a method for ascertaining a precontrol signal for the precontrol of the pressure regulating device of FIG. 1.

To achieve the best possible dynamics when setting the pressure in fuel pressure accumulator 22, pressure regulating device 32 is precontrolled. This means that, taking into account the setpoint pressure, a precontrol signal in the form of a precontrol current $I_{DRV}$ is generated by open- and closed-loop control unit 34 with an output stage connected in between. Minor system deviations must then be additionally compensated for by the above-described closed-loop control circuit. The provision of precontrol current $I_{DRV}$ is now elucidated in detail with reference to FIG. 2.

Rotational speed nmot of crankshaft 28 provided by speed sensor 29 is supplied to a characteristics curve 38, which ascertains, from rotational speed nmot, a quantity $q_{HDP}$ pumped by high-pressure fuel pump 18. Characteristics curve 38 is based on the assumption that metering unit 20 is adjusted in such a way that it does not limit the pumping performance of high-pressure fuel pump 18. Furthermore, the sum of a fuel quantity $q_{INJ}$ and a fuel quantity $q_{CON}$ is formed in an addition block 40. The quantity $q_{INJ}$ is the fuel quantity which is injected by injectors 24 into combustion chambers 26.

The quantity $q_{CON}$ is the control fuel quantity which is used by injectors 24 for their operation and which is recirculated to fuel reservoir 14 via a return flow line identified by the numeral 42 in FIG. 1. Fuel quantity $q_{INJ}$ is also determined by open- and closed-loop control unit 34 as a function of state and performance quantities and as a function of the desired torque. The return flow fuel quantity $q_{CON}$ results from these quantities with the help of a characteristics curve for example.

The sum formed in addition element 40 corresponds to the total fuel quantity requested by injectors 24 from fuel pressure accumulator 22. In block 44 this sum is subtracted from fuel quantity $q_{HDP}$ which is pumped by high-pressure fuel pump 18 into fuel pressure accumulator 22. A first flow balance for the fuel pressure accumulator is thus produced in blocks 40 and 44. The difference obtained in block 44 corresponds to a fuel quantity $q_{DRV}$ which flows back from fuel pressure accumulator 22 through pressure regulating device 32 and to fuel reservoir 14 via a line 45.

This value, together with the value provided by pressure sensor 36 for actual pressure pr_actual, which prevails in fuel pressure accumulator 22, is supplied into a characteristics map 46, which generates a correction factor KF. In block 48 it is multiplied by a raw precontrol current $I^*_{DRV}$, which was generated with the aid of a characteristics curve 50 into which a setpoint pressure pr_setpoint to prevail in fuel pressure accumulator 22 was supplied. The result of the multiplication in block 48 is precontrol current $I_{DRV}$ by which pressure regulating device 32 is precontrolled.

Through correction factor KF it is taken into account that the current required to set a certain opening pressure at pressure regulating device 32 depends on fuel quantity $q_{DRV}$ flowing through pressure regulating device 32 and instantaneous actual pressure pr_actual prevailing in fuel pressure accumulator 22. The above-described method is stored in a memory of open- and closed-loop control device 34 as a computer program.

What is claimed is:

1. A method for operating a fuel system of an internal combustion engine, comprising:

ascertaining a raw precontrol signal by taking into account a predefined setpoint pressure in a fuel pressure accumulator of the fuel system;

ascertaining a correction factor by taking into account (i) the value of a fuel quantity flowing through a pressure regulating, device for the fuel pressure accumulator and (ii) actual pressure in the fuel pressure accumulator;

ascertaining an adjusted precontrol signal by multiplying the raw precontrol signal by the correction factor; and precontrolling the pressure regulating device using the adjusted precontrol signal.

2. The method according to claim 1, wherein a fuel quantity pumped by a high-pressure fuel pump connected to the fuel pressure accumulator is taken into account when ascertaining the value for the fuel quantity flowing through the pressure regulating device.

3. The method according to claim 2, wherein the high-pressure fuel pump is mechanically driven by the internal combustion engine, and a rotational speed of the internal combustion engine is taken into account when ascertaining the value for the fuel quantity flowing through the pressure regulating device.

4. The method according to claim 1, wherein a fuel quantity reaching the combustion chamber via an injector connected to the fuel pressure accumulator is taken into account in ascertaining the value for the fuel quantity flowing through the pressure regulating device.

5. The method according to claim 1, wherein a fuel quantity controlled by an injector connected to the fuel pressure accumulator is taken into account when ascertaining the value for the fuel quantity flowing through the pressure regulating device.

6. A non-transitory computer-readable medium for an open- and/or closed-loop control unit of an internal combustion engine, the computer-readable medium storing a computer program which, when executed by a processor, performs the following method for operating a fuel system of the engine:

ascertaining a raw precontrol signal by taking into account a predefined setpoint pressure in a fuel pressure accumulator of the fuel system;

ascertaining a correction factor by taking into account (i) the value of a fuel quantity flowing through a pressure regulating device for the fuel pressure accumulator and (ii) actual pressure in the fuel pressure accumulator;

ascertaining an adjusted precontrol signal by multiplying the raw precontrol signal by the correction factor; and precontrolling the pressure regulating device using the adjusted precontrol signal.

7. An open- and/or closed-loop control unit for operating a fuel system of an internal combustion engine, the control unit comprising:

means for ascertaining a raw precontrol signal by taking into account a predefined setpoint pressure in a fuel pressure accumulator of the fuel system;

means for ascertaining a correction factor by taking into account (i) the value of a fuel quantity flowing through a pressure regulating device for the fuel pressure accumulator and (ii) actual pressure in the fuel pressure accumulator;

means for ascertaining an adjusted precontrol signal by multiplying the raw precontrol signal by the correction factor; and means for precontrolling the pressure regulating device using the adjusted precontrol signal.

8. The control unit according to claim 7, wherein the control unit is contained in an internal combustion engine of a motor vehicle.

* * * * *